United States Patent [19]

Albrecht et al.

[11] Patent Number: 4,875,242

[45] Date of Patent: Oct. 24, 1989

[54] COMPACT TOILET SEAT COVER

[75] Inventors: Leonard N. Albrecht, Irvine; Steven R. Burke, Huntington Beach, both of Calif.

[73] Assignees: Alvin S. Haining; Katherine R. Haining, both of Mission Viejo, Calif.

[21] Appl. No.: 116,857

[22] Filed: Nov. 4, 1987

Related U.S. Application Data

[63] Continuation-in-part of Ser. No. 112,866, Oct. 23, 1987, abandoned.

[51] Int. Cl.[4] ..... A47K 13/16

[52] U.S. Cl. ..... 4/243

[58] Field of Search ..... 4/242, 243, 244, 245, 4/247

[56] References Cited

U.S. PATENT DOCUMENTS

| | | | |
|---|---|---|---|
| 1,155,260 | 9/1915 | Meyer | 4/243 |
| 1,268,024 | 5/1918 | Levin | 4/243 |
| 1,304,511 | 5/1919 | Quackenbush | 4/243 |
| 1,377,791 | 5/1921 | Potschner | 4/243 |
| 1,505,087 | 8/1924 | Christman, Jr. | 4/243 |
| 1,509,868 | 9/1924 | Harrison | 4/243 |
| 1,835,787 | 12/1931 | Knisely | 4/243 |
| 1,846,960 | 2/1932 | Grammas | 4/243 |
| 1,999,676 | 4/1935 | Wilkniss | 4/243 |
| 2,084,890 | 6/1937 | Boyd | 4/243 |
| 2,280,092 | 4/1942 | Kirch et al. | 4/243 |
| 3,851,341 | 12/1974 | Aoyama | 4/243 |

FOREIGN PATENT DOCUMENTS

| | | | |
|---|---|---|---|
| 2656496 | 11/1978 | Fed. Rep. of Germany | 4/242 |
| WO88/01844 | 9/1986 | PCT Int'l Appl. | 4/243 |
| 206428 | 11/1923 | United Kingdom | 4/243 |

*Primary Examiner*—Henry J. Recla
*Assistant Examiner*—Robert M. Fetsuga
*Attorney, Agent, or Firm*—Allan R. Fowler

[57] ABSTRACT

Disclosed is a toilet seat cover in the form of a composite paper sheet which disintegrates when immersed in water, the paper sheet being of general rectangular configuration, of adequate size to cover the toilet seat, and having an opening formed centrally therein; the sheet includes a top layer of dry creped paper, emboss laminated with a bottom layer of flat machine finished or machine glazed finished paper. The sheet has opposite rear and forward margins and opposite lateral margins extending therebetween. A piece of double-sided adhesive tape is disposed on the bottom layer of paper proximate the rear margin of the sheet for releasably anchoring the cover to the rear portion of the conventional toilet seat. The sheet is folded into a compact configuration in which the adhesive tape is accessible for exposure and application and opposite margins of the sheet are accessible for manually deploying the sheet over the toilet seat preferably with the assistance of the anchor provided with the adhesive tape. The sheet is oversize relative to the toilet seat and has substantial overhanging skirt and other defined portions which may be torn off for emergency use as a wiping material. Two different folding schemes are disclosed both utilizing "Z" folds in a manner to facilitate manual deployment of the cover on the toilet seat with no requirement for direct hand contact with the toilet seat.

16 Claims, 3 Drawing Sheets

FIG. 7.
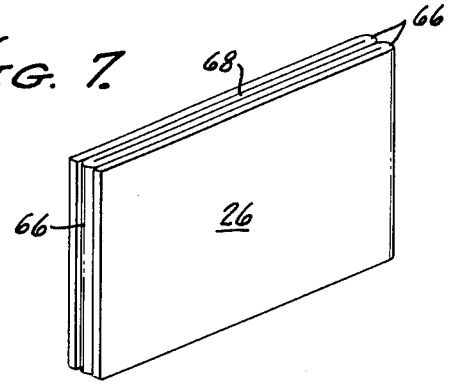
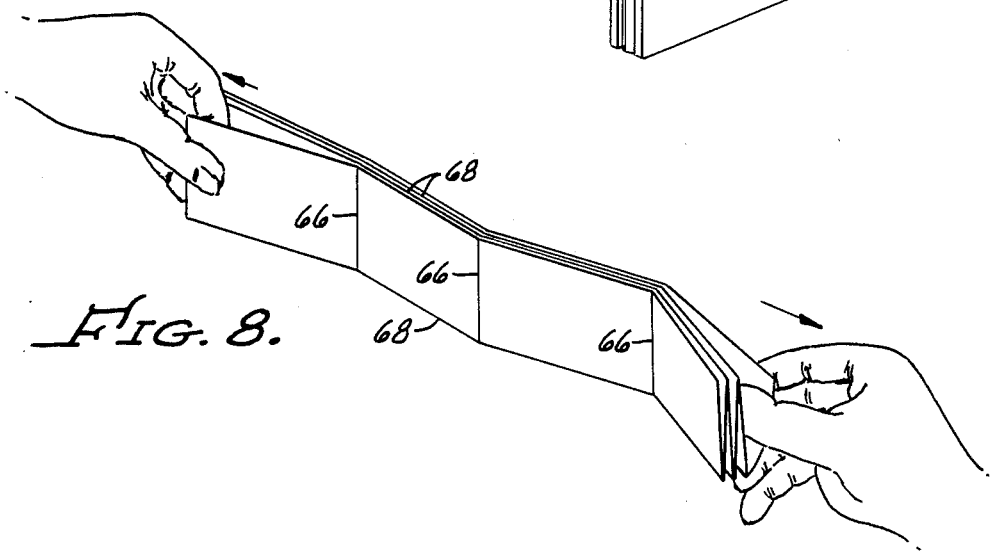
FIG. 8.
FIG. 9.
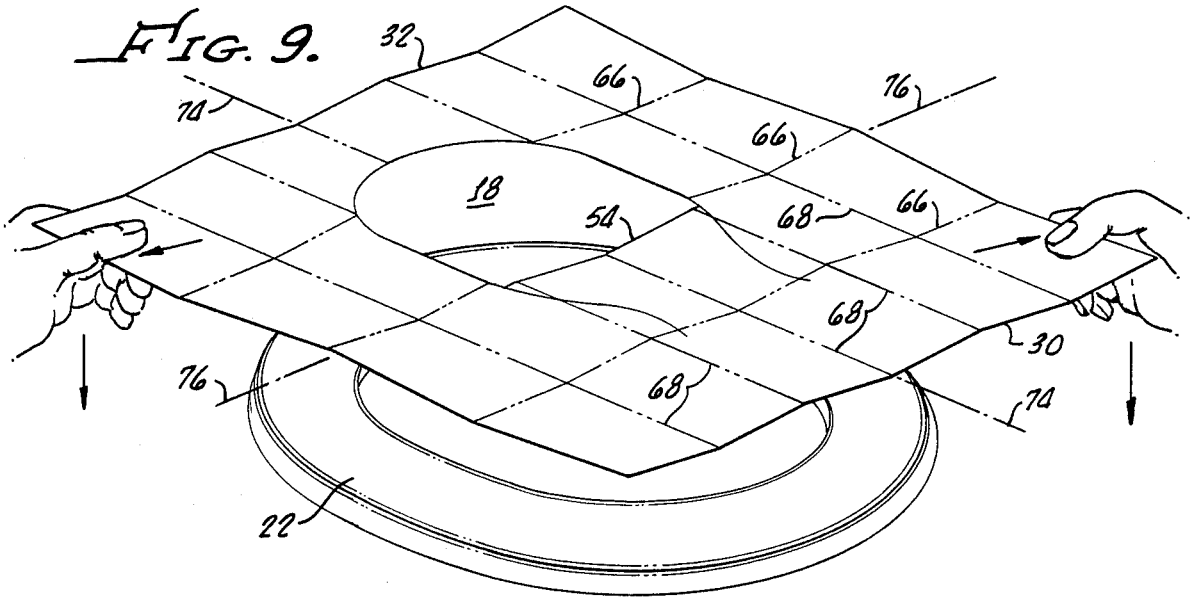

COMPACT TOILET SEAT COVER

This application is a Continuation-In-Part of our prior application of the same title, Ser. No. 112,866, Filed Oct. 23, 1987, now abandoned.

This invention relates to disposable paper sheet covers for conventional toilet seats and more specifically has reference to an improved toilet seat cover in the form of a composite paper sheet folded in a compact configuration for carrying on the person and subsequent easy deployment on a toilet seat in a sanitary manner.

Disposable paper toilet seat covers are manufactured and marketed for industrial commercial sales by a number of forest product companies. The toilet seat covers are generally known to the public as being conveniently dispensed from large containers mounted on the walls of publicly available toilet facilities such as in office buildings, airports, hotel and restaurant facilities, or the like, being extractable therefrom from essentially in sheet form with a minimum of folds.

Traditional toilet seat cover paper is about nine to eleven pounds basis weight single ply and is either machine glazed finished (MG), machine finished (MF) or two-sided (MG/MF). Machine finish and machine glazed finish are designations for paper which are well known in the disposable industrial paper product and conversion business and generally refer to flat papers whose strengths, structural properties and surface finish have been converted through mechanical processing rather than through the addition of binders, wet strength additivies, or the like.

Conventional toilet seat cover paper contains either none or only minimal wet strength additives so as to allow it to break down rapidly in septic tanks and disposal systems. As compared to creped paper (e.g., conventional soft toilet paper) conventional toilet seat cover paper is made from flat MG or MF finished paper which, being relatively highly compressed and hard surface finished, is somewhat more water resistant and does not tack (stick) to surfaces as easily. The flat MG or MF sheet also converts and die cuts better and is stronger structurally.

The conventional paper toilet seat cover is very lightweight and, as is well known, is dispensed in an almost unfolded condition and, when set in place on a conventional toilet seat, is only precariously disposed thereon and at times shifts position as might result from a draft of air or, for various reasons, is unintentionally shifted in position or moved entirely off the seat during the process of the user assuming a sitting position. Thus, sometimes the user's body comes directly in contact with a toilet seat which might not be in a sanitary condition. So far as is known, toilet seat covers are not conventionally available in a compact folded configuration, and it would appear that a compact folding of a toilet seat cover would make it even more difficult to apply and deploy securely in a proper position on a toilet seat.

Accordingly, it is an object of the present invention to provide a disposable paper cover for conventional toilet seats which utilizes a heavier multiple layer composite paper sheet, including a soft top layer of creped paper which is emboss laminated with a bottom layer of flat MG or MF paper. The process of emboss lamination of plies of paper is a conventional process well known in the paper conversion art. This is a mechanical method of lamination, and does not substantially interfere with the desired disintegration of the paper when immersed in water.

It is also an object of the present invention to provide a disposable paper toilet seat cover folded and packaged in a compact configuration for convenience in carrying the same in the user's pocket or purse and for convenience in dispensing the same from a vending machine, while at the same time providing for the easy and dependable application and deployment of the cover on a toilet seat in a sanitary manner which does not require direct contact by the user with the toilet seat.

In accordance with one embodiment of the present invention, a composite paper sheet is provided which disintegrates when immersed in water sufficiently that it may be flushed in the toilet without creating problems with the toilet plumbing or with any conventional septic tank connected with the plumbing. The paper sheet is of generally rectangular configuration, is of adequate size to cover the toilet seat, and has an opening formed centrally therein for general registration with the toilet opening defined by the conventional toilet seat.

The composite paper sheet includes a top layer of creped paper emboss laminated with a bottom layer of flat machine finished or machine glazed finished paper, and has rear and forward margins and lateral margins extending between the rear and forward margins.

Adhesive means is disposed on the bottom layer of the composite paper sheet proximate the rear margin of the sheet for releasably anchoring the sheet to the rear portion of the surface of a toilet seat.

The composite sheet is folded into a compact configuration, in which the adhesive means is accessible for exposure and application to the rear portion of the toilet seat, and in which the forward margin of the composite sheet is accessible for grasping with the hands at locations proximate the lateral margins of the sheet, and for pulling against the anchor provided by said adhesive means and separating the hands, whereby to deploy the sheet over the toilet seat. Folds are provided which are configured to unfold upon such pulling and separation thereby to facilitate deployment of the sheet over the toilet seat with the bottom layer thereof in contact with the toilet seat and with the top layer thereof exposed for direct contact with the body of the user, whereby to facilitate the deployment of the sheet on the toilet seat without requiring direct contact of the hands with the toilet seat.

In a preferred embodiment of the invention, the sheet is retained in a substantially "Z" folded configuration by a suitable package; the sheet is oversized relative to the toilet seat and has overhanging outer skirt portions which may be removed for emergency use as a wiping material; and adhesive means are disposed at spaced apart locations on the bottom layer of the sheet proximate the front margin of the sheet for releasably anchoring the front margin of the sheet to the front of the toilet seat.

In an alternative embodiment of the present invention, the adhesive means of the preferred embodiment is eliminated and a composite sheet of similarly laminated paper layers with a similar opening formed centrally therein is folded into a compact configuration, in which one pair of opposite margins of the composite sheet (e.g., the rear and forward margins) are accessible for grasping with the hands and pulling apart from each other, with folds being configured to unfold upon such pulling, thereby to extend the sheet in a first direction and, in which, after such pulling, the other pair of opposite margins of the laminated sheet (e.g., the respective lateral margins) are accessible for grasping with the hands and pulling apart from each other, with folds being configured to unfold upon such pulling, thereby to extend the sheet in a second direction transverse to the first direction, whereby to facilitate deployment of the sheet onto the toilet seat with the bottom layer thereof in contact with the toilet seat and the top layer thereof exposed for direct contact with the user, without requiring direct contact between the user's hands and the toilet seat. The composite sheet, which is relatively heavy compared to a conventional toilet seat cover sheet, is thereafter retained by its own weight against the toilet seat.

Other objects and advantages of the invention will be apparent from the following description of a preferred and an alternate embodiment thereof made with reference to the accompanying drawings, in which:

FIG. 7 is a perspective view of the alternative embodiment of the toilet seat cover of the invention in its compact folded configuration;

FIG. 8 is a perspective view of the cover of FIG. 7 unfolding longitudinally; and, FIG. 9 is a perspective view of the cover of FIG. 7 unfolding laterally for deployment on a toilet seat.

Figure 1:
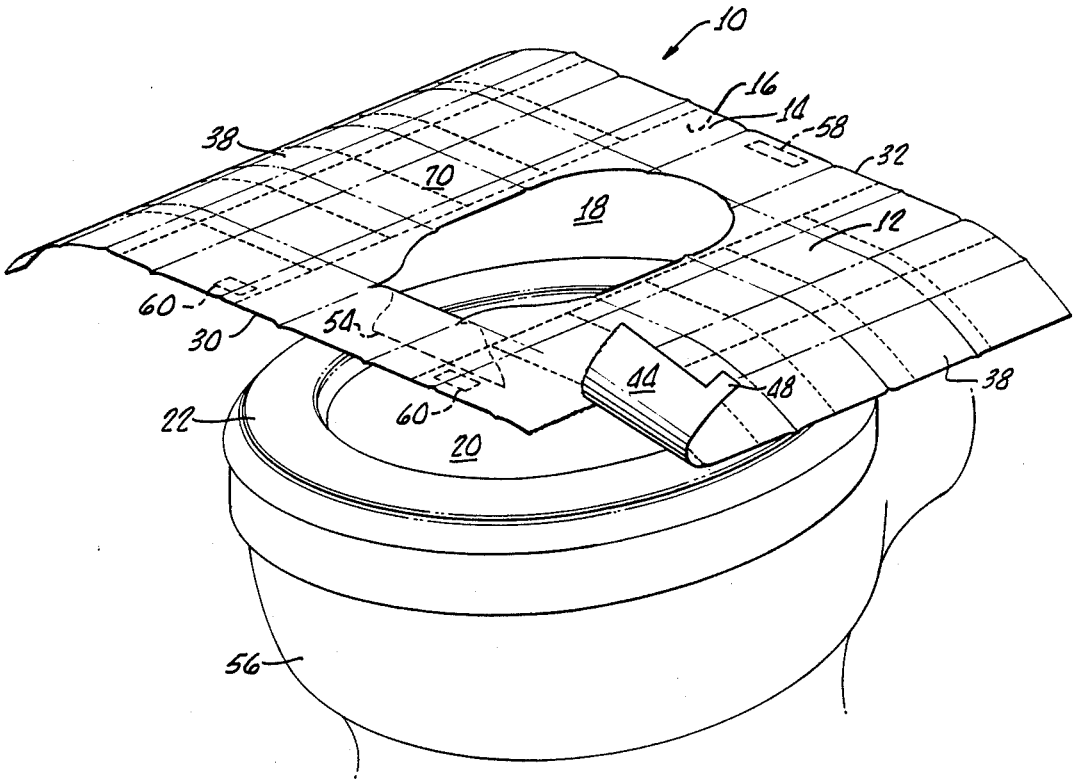
FIG. 1 is a perspective view of the preferred embodiment of the toilet seat cover deployed over a toilet seat.
Figure 2:
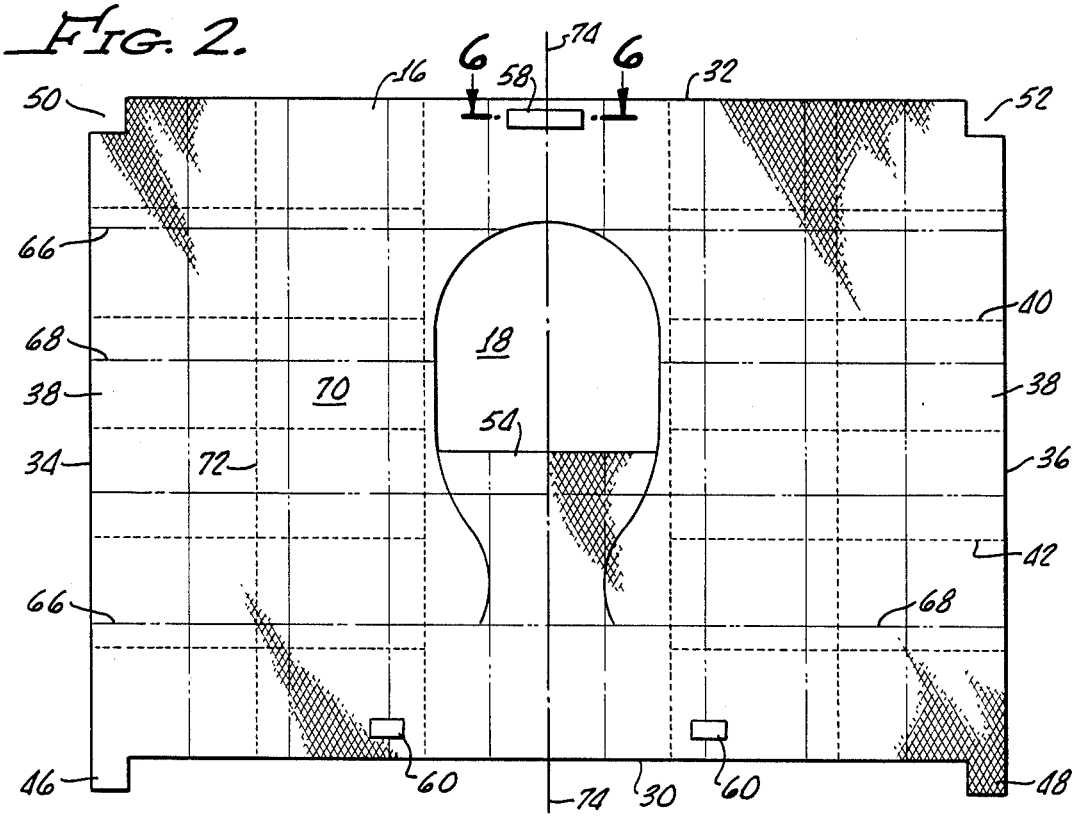
FIG. 2 is a bottom plan view of the toilet seat cover of FIG. 1 in its unfolded configuration.

Turning to FIGS. 1 and 2, the toilet seat cover 10 comprises an approximately rectangular composite sheet of paper 12 of adequate size to cover a conventional toilet seat, the sheet 12 having a top side 14 and a bottom side 16. The sheet 12 has an opening 18 formed centrally therein for general registration with the seat opening 20 of a conventional toilet seat 22, upon which the toilet seat cover 10 is designed to rest. The toilet seat 22 is entirely conventional, and is made of materials conventionally used for making toilet seats.

Figure 6:
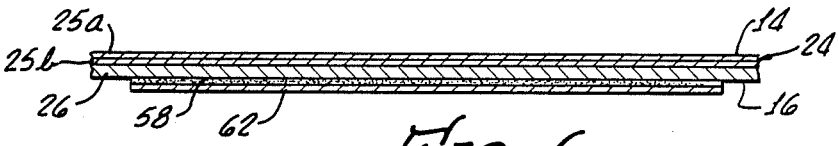
FIG. 6 is a magnified cross-section taken along line 6—6 of FIG. 2; and shows the adhesive, the adhesive's liner, and the laminate nature of the toilet seat cover.

As best seen in FIG. 6, the composite sheet 12 is a multi-ply emboss laminated paper sheet having a top layer 24 and a bottom layer 26. The top layer 24 is a two-ply dry creped tissue of ten pound basis weight per ply, and is comprised of an outer ply 25*a* and an inner ply 25*b*. The bottom layer 26 is one-ply, 19 pound basis weight, machine glazed finish paper. This laminate sheet construction provides softness to the user and resistance against contaminants on the toilet seat 22, while also affording enhanced strength for facilitating the rapid unfolding and deployment of the sheet, and enhances the sheet's utility for emergency use as a wiping material.

The composite sheet 12 has a front margin 30, an opposite rear margin 32 and opposite left and right lateral margins 34, 36, extending therebetween (left and right as is viewed from the top side 14 of the front margin 30 of the sheet).

As can be seen in FIGS. 1 and 2 by inspection, the generally rectangular sheet 12 is oversized relative to the toilet seat 22 and has substantial overhanging skirt portions 38 extending along and defining the opposite lateral margins of the sheet. These skirt portions may be torn off for emergency use as a wiping material. Indeed, in an emergency, essentially the entire sheet can be so used. To facilitate the tearing off of the skirt portions as well as other portions of the sheet for use as emergency wiping purposes, a number of longitudinal and transverse tear lines consisting essentially of aligned interrupted slits in the sheet are provided in an intersecting pattern as represented by the longitudinal dotted lines 40 and the intersecting lateral dotted lines 42 shown in FIGS. 1 and 2, which intersect to define individual toilet sheets as shown typically at 44 in FIGS. 1 and 2.

Figure 3:
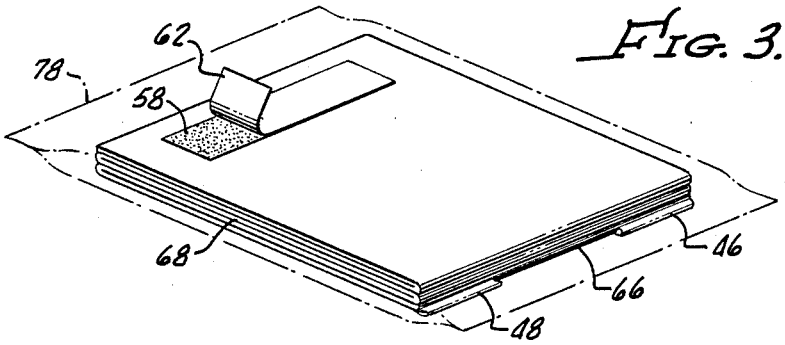
FIG. 3 is a perspective view of the toilet seat cover of FIG. 1 in its compact folded configuration with the bottom side facing upward.

The front margin 30 includes left and right pull tabs 46, 48. The pull tabs 46, 48 protrude forward from the front margin 30 at spaced apart locations proximate the lateral margins 34, 36 respectively of the sheet. The exact location of the pull tabs 46, 48 along the forward margin 30 is such that, when the toilet seat cover 10 is in its compact folded configuration (as seen in FIG. 3), when viewed from the top side 14, the left pull tab 46 is to the left of the right pull tab 48, as will be further described, to facilitate unfolding and deployment of the sheet.

As seen in FIG. 2, notches 50, 52 lie in the rear margin 32 of the sheet 12 respectively near the rear corners of the sheet. It is convenient to manufacture toilet seat covers 10 from blanks which cause the front margin 30 of one toilet seat cover 10 to have the same shape, inverted, as the rear margin 32 of the next toilet seat cover 10. Providing pull tabs on the front margin 30 of the one toilet seat cover 10 therefore cuts corresponding notches 50, 52 into the rear margin 32 of the next toilet seat cover.

The central opening 18 in the composite sheet 12 is formed in a conventional manner by a perimeter cut 19 generally of inverted "U" shape in pattern as viewed from the front margin so as to leave a protective flap 54 securely attached at the forward end of the opening 18, with the cut line 19 being interrupted sufficiently to tack the protective flap 54 in place until detached from the cut line by the user thus expanding the opening 18 and permitting the flap 54 to hang down into the bowl 56 of the toilet.

Conventionally, the protective flap 54 would occupy the entire space shown for the opening 18 by extending to occupy the entire space within the perimeter cut 19 and being tacked to the balance of the sheet along the perimeter cut, such that there would be no central opening in the sheet except as and to the extent that the flap was detached from the perimeter cut. However, as shown for example in FIG. 2, the protective flap 54, in accordance with the present invention, is foreshortened, thus leaving an actual and unimpeded opening 18 pre-formed in the sheet, which facilitates the deployment of the composite sheet 12 on the toilet seat.

Adhesive means 57 is disposed on the bottom side 16 of the sheet 12 proximate the rear margin 32 of the sheet for releasably anchoring the sheet to the rear portion of the conventional toilet seat 22. As best seen in FIGS. 3 and 6, the adhesive means 57 includes a small piece of tape 58 and a protective liner 62. The tape 58 has adhesive on both sides and is designed to adhere more agressively on one side than the other. The PC9415 product of 3M Corporation is suitable for this purpose. The agressive adhesive side of the tape 58 is applied to the bottom 16 of the sheet 12, thus leaving the more passive adhesive side facing outwardly. The protective liner 62 is conventional and may be made of a material such as kraft paper. The liner 62 covers and protects the outer side of the adhesive tape 58, and may be peeled therefrom in order to expose the adhesive for removable application to the toilet seat to releasably anchor the sheet 12 thereto, thereby to facilitate the retention of the sheet on the toilet seat as well as to facilitate the deployment of the sheet thereon from its compact folded configuration, and aid in the separation of the sheet from the user's body upon standing up from the sitting position.

As seen in FIG. 2, the composite sheet 12 has a longitudinal center line 74, and the adhesive means 57 disposed proximate the rear margin 32 of the sheet lies on this center line. In addition, a pair of adhesive means 60 are respectively disposed on the bottom side 16 of the sheet at spaced apart locations proximate the forward margin 30 on opposite sides of the longitudinal center line 74. The adhesive means 60 are of the same construction as the adhesive means 57 which lies proximate the rear margin of the sheet and serve to further anchor the sheet, if desired, to the front portion of the toilet seat 22.

Figure 4:
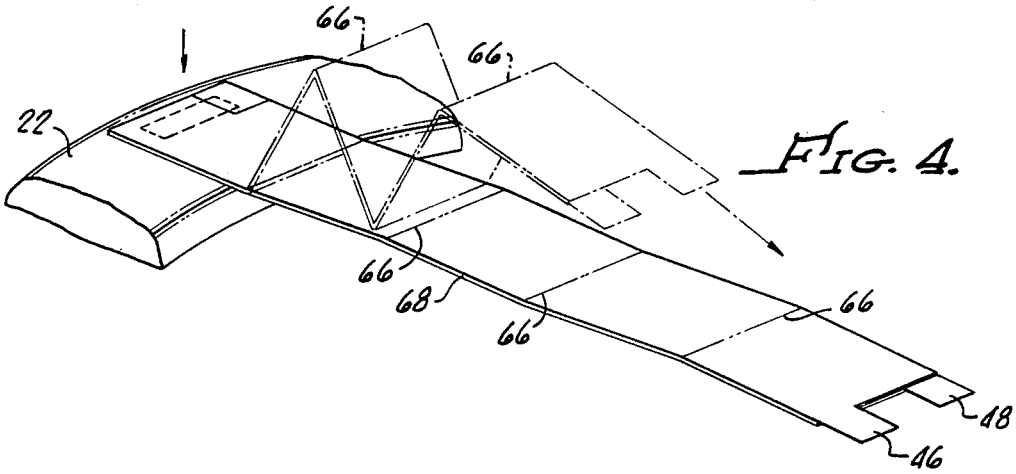
FIG. 4 is a perspective view of the toilet seat cover of FIG. 1 following anchoring thereof to the rear of the toilet seat and the partial unfolding thereof to extend the cover longitudinally, but remaining fully folded laterally; and shows, in phantom line, the toilet seat cover's configuration when only partially unfolded longitudinally.
Figure 5:
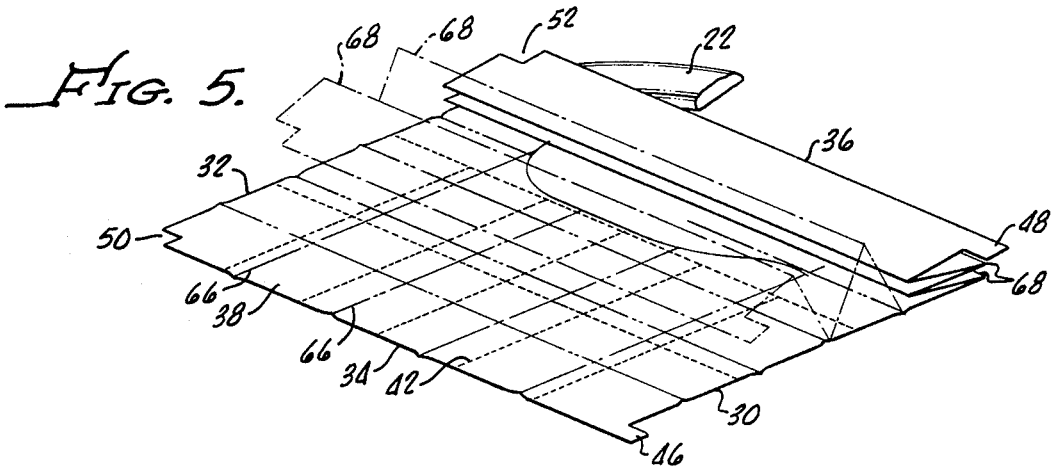
FIG. 5 is a perspective view of the toilet seat cover of FIG. 1 when it has been fully unfolded longitudinally, with the left side of the sheet (as viewed from the top side of the sheet, and extending from the center line to the left margin) being unfolded laterally, and with the right side of the sheet remaining folded in a separate "Z" fold configuration.

Referring now to FIGS. 3, 4 and 5, the toilet seat cover is stored and retained in a compact folded configuration in a close fitting package 78. To use the cover, the package 78 is torn open, the cover is removed therefrom, and the user removes the liner 62 from the accessible adhesive means 57 on the bottom side 16, and discards it. The user then turns the folded cover over and presses the exposed outer adhesive side of the tape 58 against the top surface of the toilet seat 22 adjacent the rear thereof, thereby releasably anchoring the rear margin 32 of the toilet seat cover 10 to the rear of the toilet seat 22. The user then grasps the accessible pull tabs 46, 48 at the front margin of the sheet and pulls them forward as indicated in FIG. 4 so as to unfold the lateral fold creases 66 and extend the cover longitudinally. Then, while retaining the left pull tab 46 in the user's left hand and the right pull tab 46 in the user's right hand, the user separates his hands to unfold the longitudinal fold creases 68 to expand the cover laterally (as partially depicted in FIG. 5), and deploys the cover over the toilet seat, all of which is assisted by the adhesive means anchoring the rear margin of the sheet to the rear of the toilet seat. Upon initial deployment the protective flap 54 is detached from the perimeter cut 19, and the forward adhesive means 60 may be utilized, if desired.

The compact folded configuration illustrated in FIGS. 3, 4 and 5, requires that the sheet 12 have a plurality of lateral fold creases 66 at least approximately equally spaced and parallel. It also requires the sheet to have a plurality of longitudinal fold creases 68 which are approximately equally spaced and parallel. The lateral and longitudinal fold creases 66, 68 generally are designated in phantom line, especially in FIGS. 1, 2, 5 and 9.

As best seen in FIGS. 2 and 4, the rearmost lateral fold crease 66 biases upward the portion of the sheet 12 on the forward side of the fold crease 66. Thereafter, going forward, adjacent lateral fold creases 66 alternately bias downward and upward the portion of the sheet 12 on the forward side of the fold crease 66. Such alternate biasing is called "Z" folding herein, from the similarity of the shape of the letter "Z" and the shape of a cross-section, taken perpendicular to the creases of the paper so folded.

The longitudinal fold creases 68 are also "Z" folded, to facilitate unfolding of the longitudinal fold creases to expand the sheet laterally. As best seen in FIGS. 2 and 5, the two halves of the sheet residing on opposite sides of the longitudinal center line 74 each are separately "Z" folded; that is, going laterally on each side of the longitudinal center line 74, the longitudinal fold crease 68 closest to the center line biases upward of the sheet 12 on the lateral side of the fold crease. Thereafter, going laterally, successive longitudinal fold creases 68 alternately bias downwardly and upward the portion of the sheet on the lateral side of the fold crease. Thus, the net effect is that there is no longitudinal fold crease on the center line 74 and the respective sheet halves residing to each lateral side thereof are separately "Z" folded into two separate longitudinally extending stacks, without intermingling of the longitudinal folds of one half of the sheet with those of the other. This folding facilitates the convenient and rapid deployment of the sheet on the toilet seat. Note, for example in FIG. 5, that the right sheet half to which the pull tab 48 is attached is illustrated in its "Z" folded stacked condition with the left half of the sheet being unfolded and expanded laterally.

Referring again to FIGS. 3, 4 and 5, once the folded sheet 10 has been turned over and anchored to the rear of the toilet seat 22 with the top side 14 of the sheet facing upwardly, it is important that the right hand pull tab 48 be in fact disposed on the right, with the left hand pull tab 46 disposed on the left to facilitate the lateral deployment of the sheet. By inspection of FIG. 1 or FIG. 2 for example, it can be seen that in order to cause this to happen the number of longitudinal fold creases 68 will determine the exact position of the respective pull tabs along the forward margin of the sheet. Thus, for example as seen in FIG. 2, there are four longitudinal fold creases 68 between the right hand pull tab 48 and the longitudinal center line of the sheet 74. If there were only three such longitudinal crease lines, then the "Z" folding of the right hand half of the sheet (as viewed from the top side 14 thereof) would cause the right hand pull tab 48 to be on the left hand side as viewed in FIG. 4. To avoid this and to keep the right hand pull tab 48 on the right, its position on the forward margin 30 of the sheet would have to be moved inwardly toward the center line to adjacent the first proximate longitudinal fold crease because, under these circumstances, that crease would be located at the right hand side as viewed in FIG. 4.

Turning now to FIGS. 7, 8 and 9, the alternative embodiment of the toilet seat cover 10 is seen to be generally similar to the preferred embodiment heretofore described, with two major differences: there is no adhesive means for anchoring the cover 10 to the seat 22, and there are no skirt portions or tear lines to facilitate detachment of portions of the cover for emergency use as a wiping material. The cover 10 is made of the same heavy machine glazed finished paper bottom layer 26 emboss laminated to the same two-ply dry creped paper top layer 24 as described heretofore, and is retained on the seat 22 by its own weight. Corresponding features of the alternative embodiment of the cover as shown in FIGS. 7 thru 9 utilize the same reference numerals as used in FIGS. 1 thru 6 in describing the preferred embodiment of the invention; hence, the description thereof will not be repeated.

In the alternative embodiment of the invention depicted in FIGS. 7 thru 9, the cover is completely unfolded in the air above the toilet seat, and then placed thereon; therefore it is folded somewhat differently in order to facilitate such deployment. The composite sheet 12 has a longitudinal center line 74 and a lateral center line 76. Preferably, there are an odd number of lateral fold creases 66 with one such lateral crease extending along the lateral center line 76 of the sheet and the remainder lying half on each side of the lateral center line. This causes the front and rear margins 30, 32 of the sheet to be accessible and proximate each other when the sheet is in its compact folded configuration as shown in FIG. 7, making it easier for the user to grasp the front and rear opposite margins 30, 32 to extend the sheet longitudinally as depicted in FIG. 8.

It is likewise preferable in this alternate embodiment for there to be an odd number of longitudinal fold creases 68, with one such crease 68 along the longitudinal center line 74 of the cover 10, and the remainder lying half on each side of the longitudinal center line 74 of the cover 10. Such a central longitudinal crease 68 causes the opposite lateral margins 34, 36 of the sheet 12 to be accessible and proximate each other when the sheet 12 has been unfolded longitudinally, but not yet unfolded laterally. This makes it easier for the user to grasp the opposite lateral margins 34, 36 before unfolding the sheet 12 laterally.

Preferably Z folds, both longitudinal and lateral are used in the alternative embodiment, as in the preferred embodiment. The Z fold is especially useful for the longitudinal creases 68, used to unfold and extend the cover 10 laterally.

What is claimed is:

1. A disposable paper cover for conventional toilet seats, the cover comprising:

(a) a composite paper sheet which disintegrates when immersed in water sufficiently that it may be flushed in the toilet without creating problems with the toilet pumping or with any conventional septic tank connected with the plumbing, the paper sheet being of generally rectangular configuration, of adequate size to cover the toilet seat, and having an opening formed centrally therein for general registration with the toilet opening defined by the conventional toilet seat;

(b) said composite paper sheet including a top layer of creped paper emboss laminated with a bottom layer of flat machine finished or machine glazed finished paper, whereby to preserve the structural strength of the sheet while enhancing its weight and its self-stability on the toilet seat without substantial interference with its disintegration in water; said rectangular sheet having rear and forward margins and lateral margins extending therebetween;

(c) adhesive means disposed on the bottom layer of paper proximate the rear margin and centrally between the lateral margins of the sheet for releasably anchoring the sheet to the rear portion of the conventional toilet seat; and, (d) said composite sheet being folded into a compact configuration, in which:

(1) the adhesive means is exposed for application to the rear portion of the toilet seat; and, (2) the forward margin of the composite sheet is accessible for (A) grasping with the hands at locations proximate the lateral margins of the sheet, and (B) pulling against the anchor provided by said adhesive and separating the hands, (C) with folds being configured to unfold upon such pulling followed by such separation thereby to extend the sheet over the toilet seat with the bottom layer in contact with the toilet seat and the top layer thereof exposed for direct contact with the body of the user;

(3) whereby, to facilitate the deployment of the sheet on the toilet seat without requiring direct contact between the user's hands and the toilet seat.

2. The cover of claim 1, further comprising means removably packaging and holding said cover in said compact folded configuration for convenient carrying and use.

3. The cover of claim 2, wherein the composite rectangular paper sheet is oversized relative to the toilet seat and has substantial overhanging lateral skirt portions which may be torn off for emergency use as a wiping material.

4. The cover of claim 3, wherein the lateral skirt portions are defined in part by tear lines comprised of a series of slits in the sheet to facilitate the detachment of the skirt portions from the sheet.

5. The cover of claim 1, wherein:

(a) the top layer of creped paper comprises two plies of dry creped paper of about ten pounds basis weight per ply; and, (b) the bottom layer comprises one ply of machine glazed finished paper of basis weight substantially in excess of eleven pounds.

6. The cover of claim 5, wherein the bottom layer of the composite sheet comprises a ply of machine glazed finished paper having a basis weight of about nineteen pounds.

7. The cover of claim 1, wherein the folded sheet includes:

(a) a plurality of at least approximately equally spaced and parallel lateral fold creases; and, (b) a plurality of at least approximately equally spaced and parallel longitudinal fold creases.

8. The cover of claim 7, wherein:

(a) the rearmost lateral fold crease biases upward the portion of the sheet on the forward side of the rearmost fold crease; and, (b) the lateral fold creases are Z folded.

9. A disposable paper cover for conventional toilet seats, the cover comprising:

(a) a composite paper sheet which disintegrates when immersed in water sufficiently that it may be flushed in the toilet without creating problems with the toilet plumbing or with any conventional septic tank connected with the plumbing, the paper sheet being of generally rectangular configuration, of adequate size to cover the toilet seat, and having an opening formed centrally therein for general registration with the toilet opening defined by the conventional toilet seat;

(b) said composite paper sheet including a top layer of creped paper emboss laminated with a bottom layer of flat machine finished or machine glazed finished paper, said rectangular sheet having rear and forward margins and lateral margins extending therebetween;

(c) adhesive means disposed on the bottom layer of paper proximate the rear margin of the sheet for releasably anchoring the sheet to the rear portion of the conventional toilet seat; and, (d) said composite sheet being folded into a compact configuration, in which:

(1) the adhesive means is accessible for exposure and application to the rear portion of the toilet seat;

(2) the forward margin of the composite sheet is accessible for (A) grasping with the hands at locations proximate the lateral margins of the sheet, and (B) pulling against the anchor provided by said adhesive and separating the hands, (C) with folds being configured to unfold upon such pulling and separation thereby to extend the sheet over the toilet seat with the bottom layer in contact with the toilet seat and the top layer thereof exposed for direct contact with the body of the user;

(3) whereby, to facilitate the deployment of the sheet on the toilet seat without requiring direct contact between the user's hands and the toilet seat;

(e) a plurality of at least approximately equally spaced and parallel lateral fold creases;

(f) a plurality of at least approximately equally spaced and parallel longitudinal fold creases;

(g) the adhesive means being disposed on the longitudinal center line of the sheet;

(h) the longitudinal fold creases avoiding the longitudinal center line of the sheet;

(i) there being an even number of longitudinal fold creases, half on each side of the longitudinal center line of the sheet;

(j) on each side of the longitudinal center line of the sheet, the longitudinal fold crease closest thereto biasing upward the portion of the sheet on the lateral side of the fold creases; and, (k) the other longitudinal fold creases on each side of the center line being Z folded separately for each side.

10. The cover of claim 9, further comprising:

(a) a left pull tab protruding forward from the forward margin of the sheet, proximate the left forward corner of the sheet; and, (b) a right pull tab protruding forward from the forward margin of the sheet, proximate the right forward corner of the sheet.

11. A disposable paper cover for conventional toilet seats, the cover comprising:

(a) a composite paper sheet which disintegrates when immersed in water sufficiently that it may be flushed in the toilet without creating problems with the toilet plumbing or with any conventional septic tank connected with the plumbing, the paper sheet being of generally rectangular configuration, of adequate size to cover the toilet seat, and having an opening formed centrally therein for general registration with the toilet opening defined by the conventional toilet seat;

(b) said composite paper sheet including a top layer of creped paper emboss laminated with a bottom layer of flat machine finished or machine glazed finished paper, said rectangular sheet having rear and forward margins and lateral margins extending therebetween;

(c) adhesive means disposed on the bottom layer of paper proximate the rear margin of the sheet for releasably anchoring the sheet to the rear portion of the conventional toilet seat; and, (d) said composite sheet being folded into a compact configuration, in which:

(1) the adhesive means is accessible for exposure and application to the rear portion of the toilet seat;

(2) the forward margin of the composite sheet is accessible for (A) grasping with the hands at locations proximate the lateral margins of the sheet, and (B) pulling against the anchor provided by said adhesive and separating the hands, (C) with folds being configured to unfold upon such pulling and separation thereby to extend the sheet over the toilet seat with the bottom layer in contact with the toilet seat and the top layer thereof exposed for direct contact with the body of the user;

(3) whereby, to facilitate the deployment of the sheet on the toilet seat without requiring direct contact between the user's hands and the toilet seat;

(e) a plurality of at least approximately equally spaced and parallel lateral fold creases;

(f) a plurality of at least approximately equally spaced and parallel longitudinal fold creases;

(g) a left pull tab protruding forward from the forward margin of the sheet, proximate the left forward corner of the sheet;

(h) a right pull tab protruding forward from the forward margin of the sheet, proximate the right forward corner of the sheet; and, the pull tabs being positioned along the forward margin of the sheet so that, when the toilet seat cover is folded, the right pull tab is to the right of the left pull tab as viewed from the top side of the sheet, while facing the forward margin thereof.

12. The cover of claim 1, further comprising a protective flap at the forward edge of the opening in the sheet, said flap being releasably tacked to the perimeter of said opening, and covering only a portion thereof while leaving a substantial portion thereof open.

13. The cover of claim 1, wherein said adhesive means comprises a piece of tape having adhesive on both sides thereof, the adhesive on one side being relatively aggressive and that on the other side being relatively passive, with the agressive adhesive being adhered to the bottom side of the sheet and the passive adhesion facing outward therefrom, and a protective liner removably adhered to the passive adhesive side of the tape.

14. The cover of claim 1, further comprising adhesive means disposed at spaced apart locations on the bottom side of the sheet proximate the front margin of the sheet for releasably anchoring the sheet to the front portion of the conventional toilet seat.

15. The cover of claim 14, wherein the front adhesive means is disposed at spaced apart locations on opposite sides of the longitudinal center line of the cover.

16. The cover of claim 1, wherein substantially all of the exterior surface of the compact folded configuration of the sheet is defined by the bottom layer of the sheet.

* * * * *